United States Patent [19]

Stein et al.

[11] 4,361,328

[45] Nov. 30, 1982

[54] SHEET INTERFITTING SECTION PUZZLE

[76] Inventors: Age Stein, Mountlake Terrace; Douglas E. Winters, Bothell, both of Wash.

[21] Appl. No.: 108,947

[22] Filed: Dec. 31, 1979

[51] Int. Cl.[3] ..... A63F 9/10

[52] U.S. Cl. ..... 273/156; 434/304; 434/333; 434/406

[58] Field of Search ..... 273/156, 157 R, 294; 35/31 F, 31 G, 35 H, 35 J, 73; 434/171, 333, 406, 304

[56] References Cited

U.S. PATENT DOCUMENTS

| | | | |
|---|---|---|---|
| 3,333,351 | 8/1967 | Williams | 273/294 X |
| 3,707,287 | 12/1972 | Spector | 273/157 R |
| 3,923,307 | 12/1975 | Sukys et al. | 273/157 R |
| 4,076,253 | 2/1978 | Eriksen | 273/294 X |

FOREIGN PATENT DOCUMENTS

| | | | |
|---|---|---|---|
| 637544 | 3/1962 | Canada | 273/294 |

OTHER PUBLICATIONS

"Geometric Puzzles", Educational Design Associates, Inc. Catalog, p. 1, copyright 1973.

"Metrodoms", The Mathematics Teacher, vol. 70, No. 3, Mar. 1977, p. 276.

*Primary Examiner*—Anton O. Oechsle

*Attorney, Agent, or Firm*—Robert W. Beach; Douglas E. Winters; Ward Brown

[57] ABSTRACT

A sheet interfitting section puzzle includes incongruent pieces with complementary indicia which are physically separated by the puzzle piece internal edges and complementally abuttable internal edges which may be arranged in only one combination with all internal edges in complementary abutting relationship. When so arranged the complementary indicia are adjacent. Internal edges may be identical and therefore pieces may fit in an incorrect location while the puzzle is being constructed, in which location indicia adjacent to complementally abutting sides would not be complementary, but all the pieces must be located in their correct locations for the puzzle to be solved.

17 Claims, 34 Drawing Figures

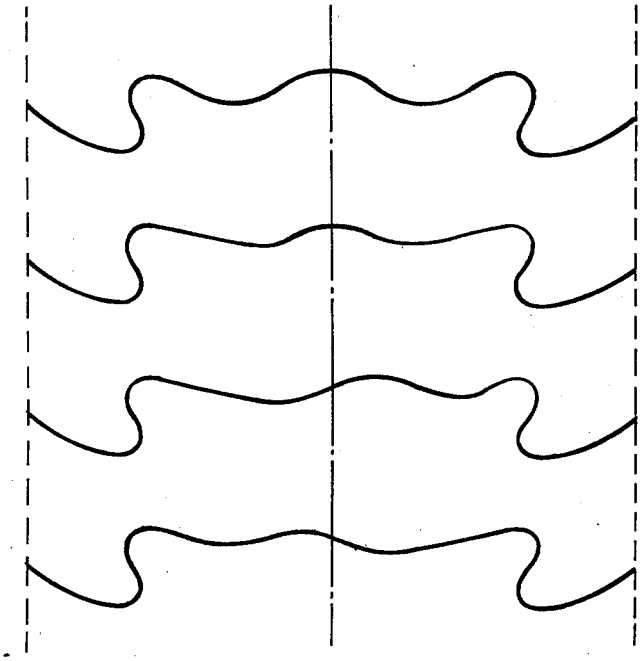
Fig. 7D.
Fig. 7A.
Fig. 7B.
Fig. 7C.
Fig. 11.
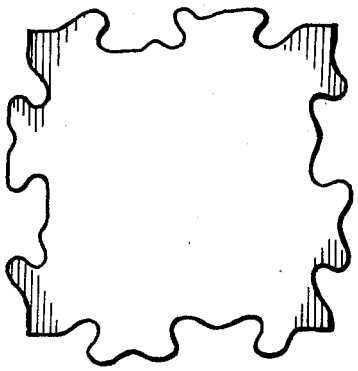
Fig. 10.
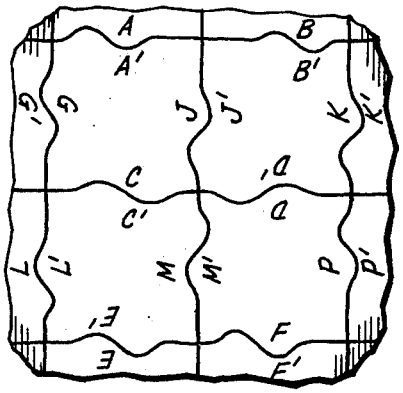
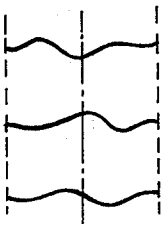
Fig. 11C.
Fig. 11B.
Fig. 11A.

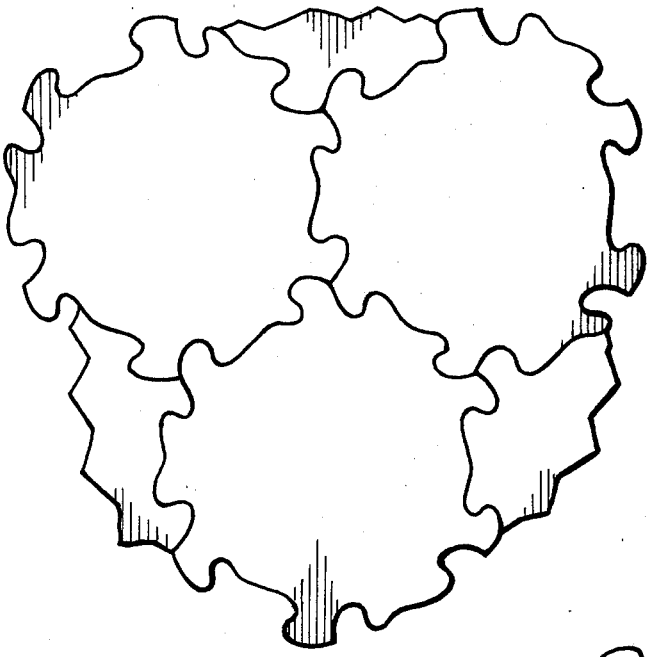
Fig. 12.
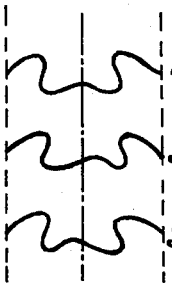
Fig. 12A.
Fig. 12B.
Fig. 12C.
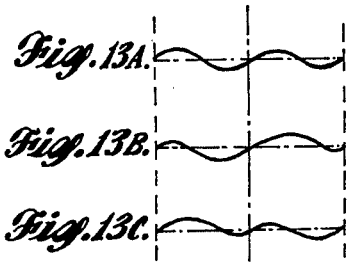
Fig. 13A.
Fig. 13B.
Fig. 13C.
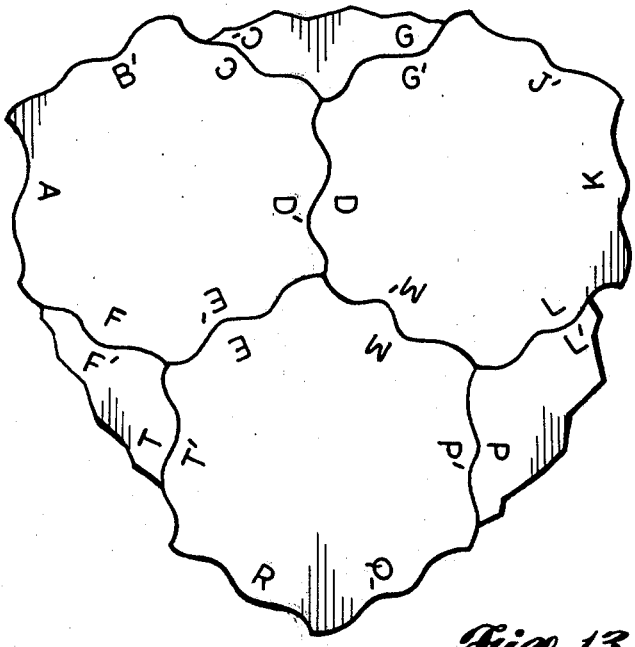
Fig. 13.
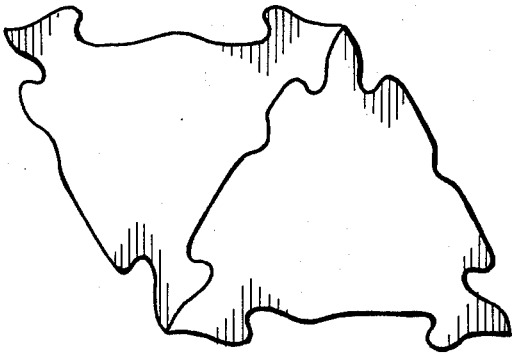
Fig. 14.

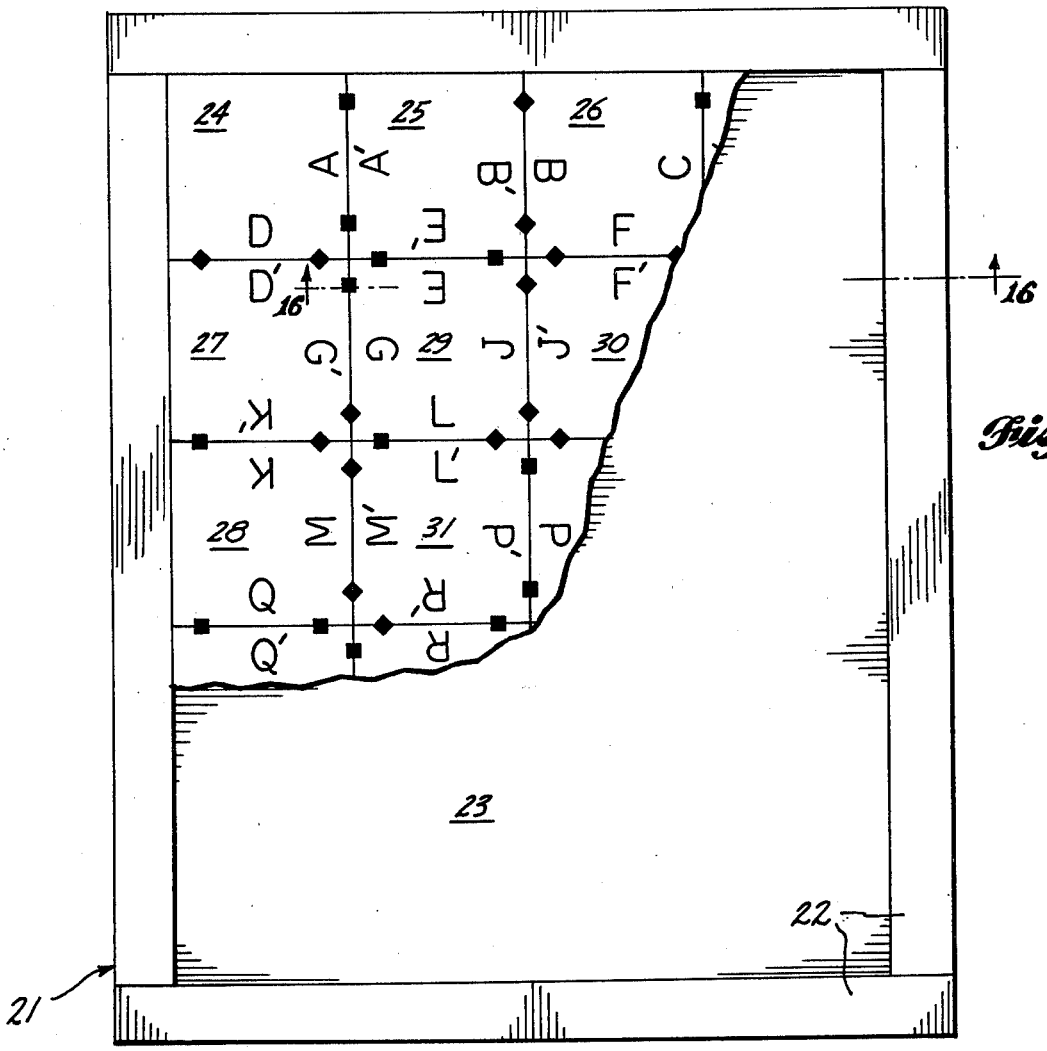
Fig. 15.
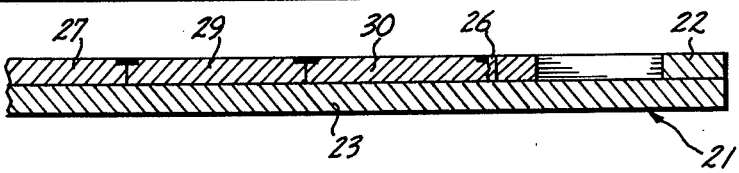
Fig. 16.
Fig. 17.
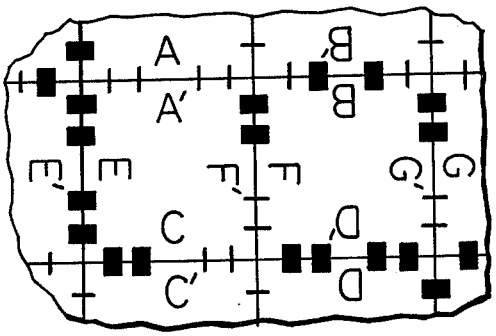
Fig. 18.
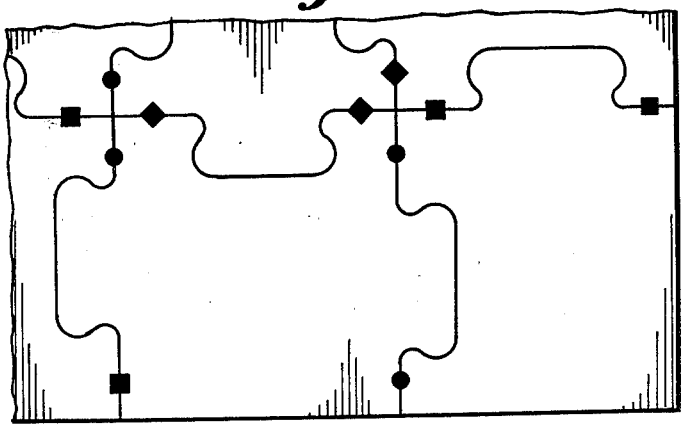

SHEET INTERFITTING SECTION PUZZLE

BACKGROUND OF THE INVENTION

1. Field of the Invention

This invention relates generally to educational and amusement devices, and moe particularly concerns sheet interfitting section puzzles.

2. Prior Art

Typically, sheet interfitting section puzzles of the prior art include incongruent and/or congruent pieces which when properly fitted together reveal a picture, design, pattern or other image. Correct placement of the pieces of prior art puzzles is aided by matching distinctive color, shade, indicia or lines which cross internal edges of the puzzle pieces. It is impossible for a puzzler to solve a puzzle including congruent pieces without the use of the aforementioned color, shade, indicia and lines.

SUMMARY OF THE INVENTION

A principal object of the present invention is to provide a sheet interfitting section puzzle of incongruent pieces which requires, to assemble the pieces effectively, association of related indicia that are not physically bisected by internal edges of the puzzle pieces.

A further object is to provide an educational device which can generate the amusement of a sheet interfitting section or jigsaw puzzle.

Still another object is to provide an educational device which will teach the correlation between complementary indicia in a manner to retain the interest of the student and not require teaching assistance from an instructor or answer sheet.

Another object is to provide a sheet interfitting section puzzle which will challenge the skill and tenacity of an older child or adult puzzler.

In accordance with the invention, a sheet interfitting section puzzle is constructed such that no two pieces are congruent, but various pieces include one or more internal edges which are identical to internal edges of other pieces. The profiles of the pieces are chosen so that the pieces can be arranged in only one combination in which all abutting internal piece edges are contiguous. Each piece includes indicia adjacent to its internal edges which, when the puzzle is correctly assembled, complement the indicia adjacent to the abutting edges of other pieces. As the puzzle pieces are being assembled, more than two piece edges will be found to be complementally abuttable, but only if all pieces having edges in abutment also have complementary indicia adjacent to such abutting edges can all the remaining pieces be assembled with all abutting edges complemental. In other words, not only must all abutting edges be complemental, but also the indicia adjacent to each set of abutting edges must be complementary. The background behind the indicia of the puzzle is uniform so that the typical assistance of matching color, indicia, shade or lines is absent. The indicia components adjacent to abutting edges are only complementary, not matching.

Preferably the correlation of all complementary indicia is not known or readily apparent to the puzzler. The puzzler must then either learn or guess at the correct correlation between complementary indicia. The complementally abutting edges are an aid to the selection of correctly correlated complementary indicia, but since one edge can complementally abut more than one other edge, the selection is not mandated. Using that aid the puzzler may assemble the puzzle by assuming a correlation between indicia components adjacent to complementally abuttable edges and mechanically fitting pieces at least to a limited extent. Since the puzzle may be arranged in only one complete combination with all internal edges complementally abutting, if the correct correlation has been assumed it will be affirmed and the puzzler's learning experience will be rearward by the solving of the puzzle. If a stage in the assembling of the puzzle pieces is reached, however, where no further puzzle piece edges are complementally abuttable, the puzzler must at least partially disassemble the assembled portion of the puzzle and rearrange complementally abutting edges because a guess as to adjacent indicia being complementary has been wrong. Such procedure consumes time and results in the puzzle being solved inefficiently. However, when the puzzle pieces are correctly assembled, the puzzler will have self-taught or self-reinforced the proper correlation between the complementary components of indicia.

Obviously, the less apparent the correlation between the complementary components of indicia, the more difficult the puzzle and the greater the challenge to the puzzler. Also, a more difficult puzzle is produced if indicia having possibly logical correlation but which are actually not complementary are located adjacent to complementally abuttable edges.

The puzzle pieces are complementally interfitting, and preferably interlocking. Also such pieces preferably have four sides and are nominally square, although the present invention does include noninterlocking pieces and multisided pieces other than square such as 3-, 5- or 6-sided pieces, for example. Also, combinations of different shapes such as 6-sided and 4-sided pieces may be used. Further, the invention is not limited to puzzles in which all internal edges are abutting; for example, octagonal pieces may be arranged with every other edge of internal pieces abutting.

BRIEF DESCRIPTION OF THE DRAWINGS

FIGS. 7A, 7B and 7C are enlarged fragmentary plans of the different undulating projection and notch shapes forming internal edges of the pieces in FIGS. 4, 5 and 6. FIG. 7D is an enlarged fragmentary plan of a modified undulating projection and notch shape.

FIG. 10, on the sheet with FIGS. 7A to 7D, is a plan of a generally square interlocking piece with indicia omitted and abutting internal edges including one notch and one projection on each internal edge.

FIG. 11 is a fragmentary plan of an assembled puzzle including generally square noninterlocking pieces with primed and nonprimed letter indicia and undulating abutting internal edges. FIGS. 11A, 11B and 11C are fragmentary plans of the different undulating shapes forming internal edges of the pieces in FIG. 11.

FIG. 12 is a fragmentary plan of an assembled puzzle including generally hexagonal interlocking pieces with indicia omitted and undulating abutting internal edges. FIGS. 12A, 12B and 12C are fragmentary plans of the different undulating shapes forming internal edges of the pieces in FIG. 12.

FIG. 13 is a fragmentary plan of an assembled puzzle including generally pentagonal noninterlocking pieces with primed and nonprimed letter indicia and undulating abutting internal edges. FIGS. 13A, 13B and 13C are fragmentary plans of the different shapes forming internal edges of the pieces in FIG. 13.

FIG. 14 is a plan of two generally triangular interlocking pieces with indicia omitted and having abutting internal edges with undulating projections and notches.

FIG. 15 is a plan of an assembled puzzle including a frame and square pieces with complementary primed and nonprimed letter indicia and abutting internal edges which include a complementally abuttable internal configuration of square and diamond symbols bisected by the internal edges, and with pieces broken away.

FIG. 16 is a vertical section taken along line 16—16 of FIG. 15 with parts broken away.

FIG. 17 is a fragmentary plan of another assembled puzzle with primed and nonprimed letter indicia and a second embodiment of a complementally abuttable internal configuration which includes wide and narrow line segments bisected by the internal edges.

FIGS. 18 and 19 are fragmentary plans of assembled puzzles with complementary indicia omitted and including a complementally abuttable internal configuration which forms interlocking internal edges and includes internal edge symbols bisected by the internal edges.

DETAILED DESCRIPTION

The main concept of this invention is to provide an educational and intriging sheet interfitting section puzzle, the pieces of which bear indicia each composed of two complementary parts of components located on different puzzle pieces, in which more than one piece may fit a particular location as the puzzle is being assembled, but in which only one piece will fit such location that bears indicia parts which are complementary, respectively, to indicia parts on all pieces contiguous to such piece. Because the puzzle may be fully assembled in only one combination, all the puzzle pieces may be mechanically fitted together without the cognitive matching of complementary indicia, but to do so would usually be an extremely time-consuming and tedious process. By knowing or learning the correlation between all the complementary indicia parts, the puzzle may be efficiently assembled and the correlation of such indicia parts verified by complete interfitting of all the puzzle pieces.

Figure 1:
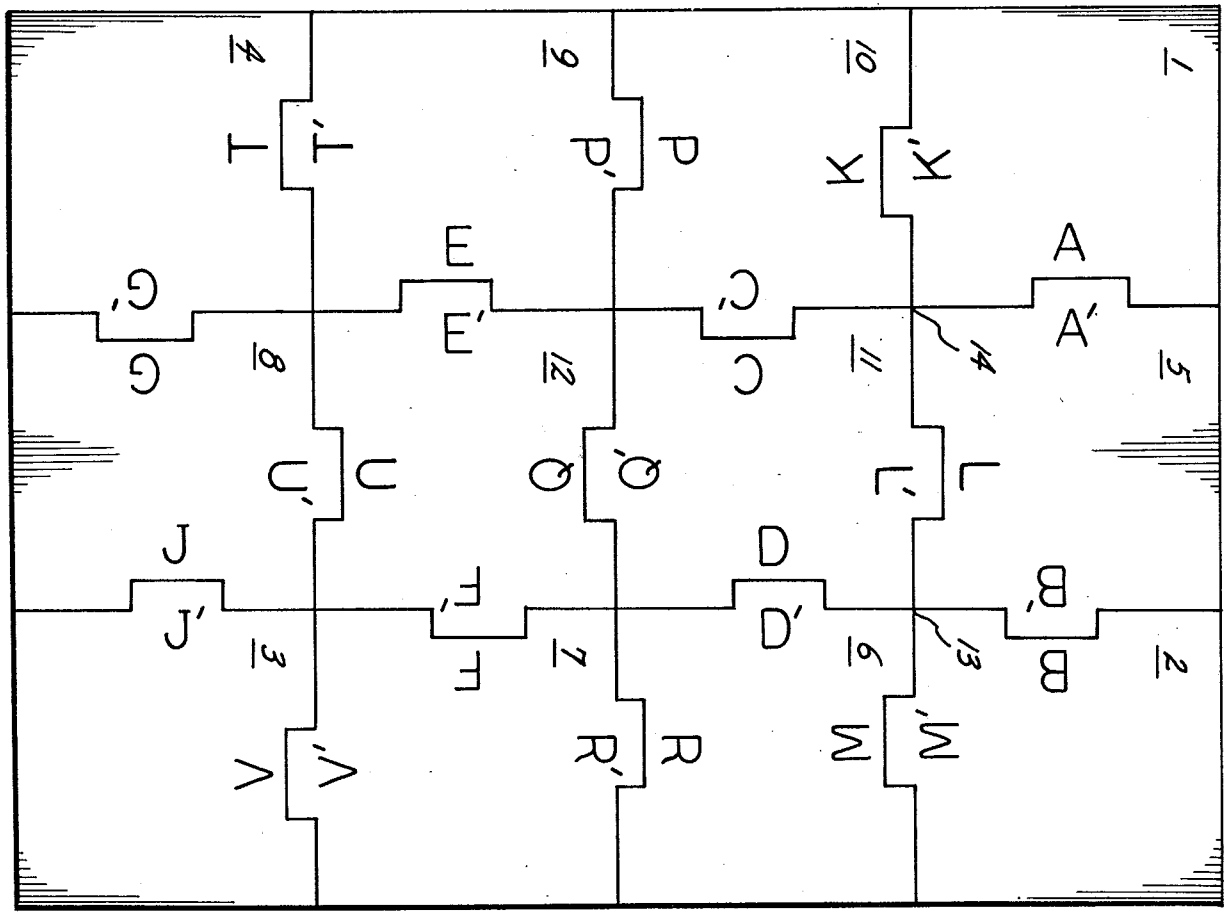
FIG. 1 is a plan of an assembled 12-piece sheet interfitting section puzzle with complementary primed and nonprimed letter indicia, abutting internal edges including rectangular projections and notches, and swastika intersections.

A representative simplified example of one embodiment of the educational sheet interfitting section puzzle following the principles of the present invention is illustrated in FIG. 1. The puzzle consists of twelve generally square pieces numbered 1 to 12, inclusive. The four corner pieces, each having two straight or border edges adjoining to form a 90° angle and two internal edges with rectangular projections and notches, are numbered 1 to 4 in clockwise sequence beginning at the upper left corner; the six side pieces, each having one straight border edge and three internal edges, are numbered 5 to 10 in clockwise sequence beginning at the top; and the two internal pieces, each having four internal edges, are numbered 11 and 12 beginning at the top. The lengths of the straight border edges of all marginal pieces are identical and the joints between internal abutting edges form a lattice structure of generally equally spaced lines. The length and width of all projections and notches are equal and, when the puzzle pieces are assembled, the swastika intersections alternate in sense of foot projection, the feet of the swastika 13 projecting clockwise, i.e. a right swastika, and the feet of the swastika 14 projecting counterclockwise, i.e. a left swastika, for example.

The complementary indicia components or parts are shown as consisting of primed and nonprimed capital letters simply for purposes of illustration.

Each corner piece includes an internal edge having one projection and an adjoining internal edge having one notch. Pieces 1 and 4 have their notch and projection adjoining internal edges arranged in clockwise sequence and pieces 2 and 3 have their notch and projection adjoining internal edges arranged in counterclockwise sequence.

Each side piece includes either two opposed protection internal edges and an interposed notch internal edge, or two opposed notch internal edges and an interposed projection internal edge. Such two types of pieces are arranged alternately circumferentially around the puzzle.

Each internal piece includes two opposed projection internal edges and two opposed notch internal edges.

No two pieces have congruent profiles and no combination of a plurality of pieces with complementally abutting internal edges has a composite profile congruent with the composite profile of any other possible combination of a plurality of pieces of the puzzle. Therefore, the puzzle pieces can be completely assembled in only one combination or arrangement with each internal edge in complemental abutment with another internal edge. When the puzzle pieces are assembled in that combination the indicia components at opposite sides of each joint formed by complementally abutting edges will be complementary. Consequently, when the puzzle is solved, the puzzler will be assured that all of the juxtaposed indicia components are indeed complementary without reference to an answer sheet or review by an instructor.

At first glance, it would appear that side pieces 5 and 9 of FIG. 1 are congruent, but on closer inspection it will be noted that the internal edge projection of piece 5 adjacent to the B' indicia component is offset slightly to the right as viewed from the center of the piece and the internal edge projection of piece 9 adjacent to the P' indicia component is offset slightly to the left as viewed from the center of the piece. All of the projections and all of the notches are thus offset instead of being centered. Hereinafter, the terms "left" and "right" will mean offset to the left or right, respectively, a predetermined equal amount from the center of an internal edge as viewed from the center of the piece. The term applies equally to notches and projections. In fact all of the notches and projections of the internal edges in the FIG. 1 puzzle are offset the same amount from the center of the edge either to the left or to the right.

In clockwise sequence from its straight border edge, side piece 5 has a right projection internal edge, a left notch internal edge and a right projection internal edge, while side piece 9 has a left projection internal edge, a right notch internal edge and a right projection internal edge. Thus each of the side pieces 5 and 9 has a right projection internal edge last in counterclockwise sequence, adjoining its straight border edge, which edges are identical in shape. Therefore the internal edge of side piece 9 adjacent to the indicia component T' can complementally abut the internal edge of corner piece 1 adjacent to the indicia component A in place of the internal edge of side piece 5 adjacent to the indicia component A', as shown in FIGS. 2A, 2B and 2C.

Figure 2A:
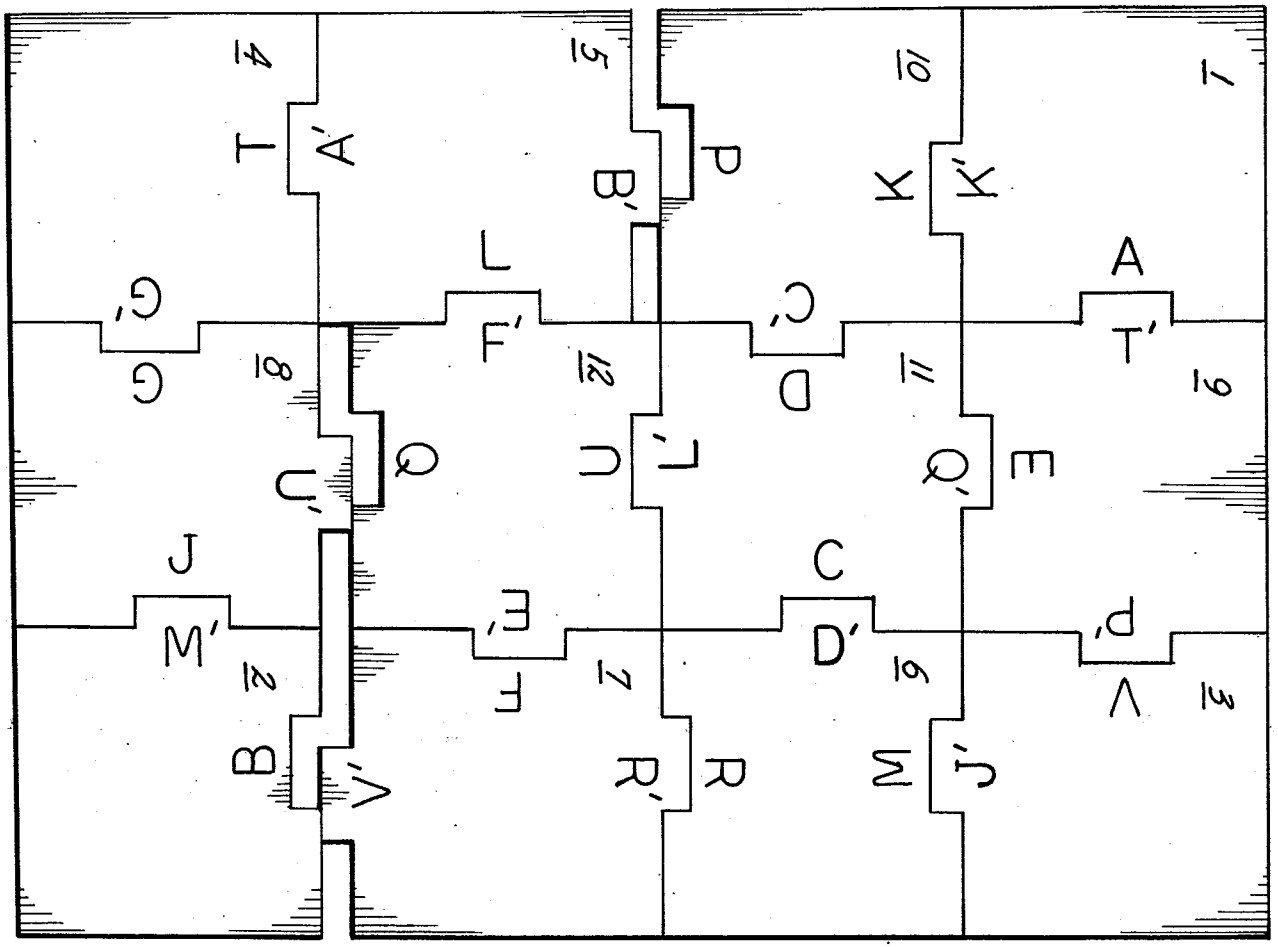
FIGS. 2A, 2B, 2C and 2D are plans of the FIG. 1 puzzle partially assembled in different ways with some noncomplementary indicia in adjacent relationship and with pieces arranged to show the nonfit of certain adjacent pieces.
Figure 2B:
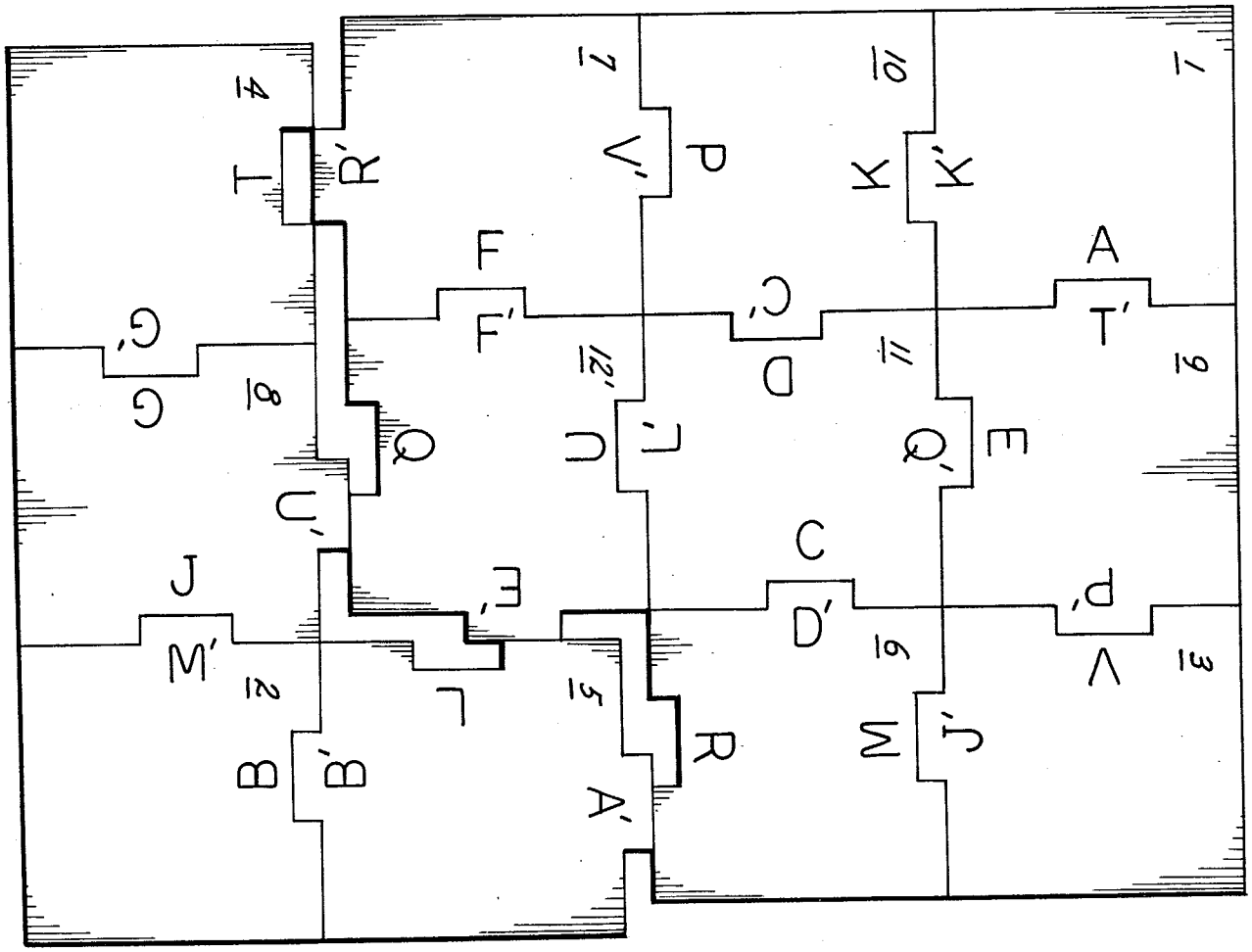
Figure 2C:
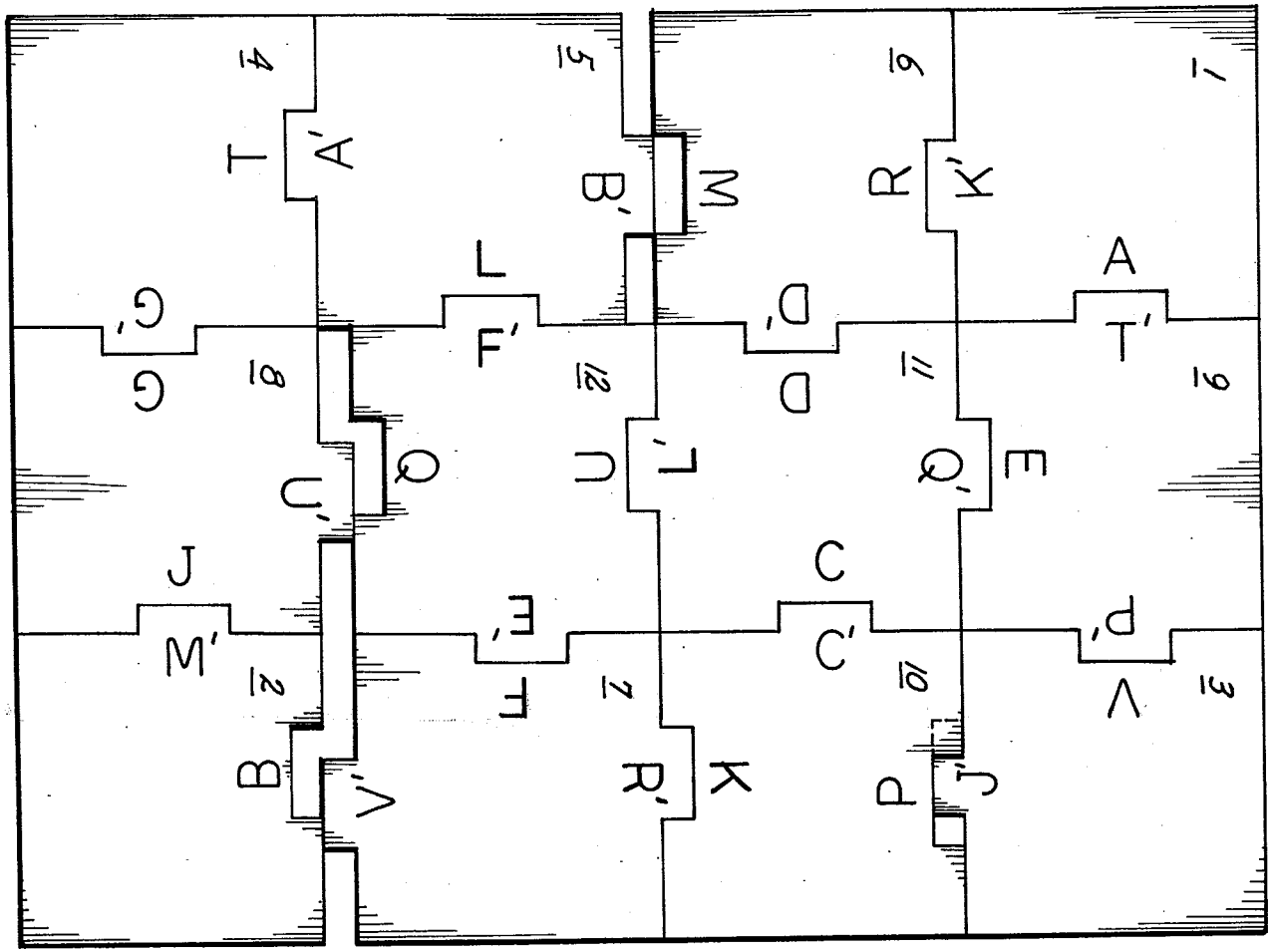

The B indicia component left notch internal edge of corner piece 2 will not complementally abut the p' indicia component left projection internal edge of side piece 9, but the V indicia component right notch internal edge of corner piece 3 will fit the P' edge as seen in FIGS. 2A, 2B and 2C. Internal pieces 11 and 12, having all internal edges, will fit in the same central locations as shown in FIG. 1. If internal piece 11 is inverted as shown in FIGS. 2A, 2B and 2C, the Q' indicia component left projection internal edge will fit the E indicia component right notch internal edge of side piece 9 and, if internal piece 12 is inverted as shown in FIGS. 2A, 2B and 2C, the U indicia component left notch internal edge will fit the L' indicia component right projection internal edge of internal piece 11. Thus, as shown graphically in these three figures, the puzzle can be partially assembled by interfitting pieces 1, 9, 3, 11 and 12 in the manner described disregarding the indicia components.

Proceeding to the bottom of the puzzle, it may be found that corner pieces 4 and 2 can be fitted to opposite edges of side piece 8 as shown in FIGS. 2A, 2B and 2C to provide a further subassembly. At that point, however, it may be discovered that the U' indicia component right projection internal edge of side piece 8 will not fit the Q indicia component right notch internal edge of internal piece 12, indicating that an error has occurred in the assembly of the puzzle prior to that stage.

If the puzzler ignores this warning and attempts to complete the puzzle, he still has side pieces 5, 6, 7 and 10 to place. He may find that side pieces 10 and 6 can be assembled as shown in FIGS. 2A and 2B, placing these pieces in the same positions as in the correct solution to the puzzle shown in FIG. 1. Such continued assembly of puzzle pieces appears to represent progress toward a solution of the puzzle, whereas actually such further assembly of the puzzle is receding from the correct solution shown in FIG. 1.

There now remain only the two side pieces 5 and 7 to assemble. As shown in FIG. 2A, side piece 7 will fit pieces 6 and 12 of the upper subassembly and side piece 5 will fit piece 4 of the lower subassembly. Also, the left notch internal edge of piece 5 will fit the left projection internal edge of piece 12, but the edges will not be contiguous and all of pieces 5, 8 and 2 of the lower subassembly will be separated from their adjacent pieces 10, 12 and 7, respectively, of the upper subassembly. Moreover, the top right projection internal edge of side piece 5 will not be in registration with the bottom right notch internal edge of side piece 10; the top right projection internal edge of side piece 8 will not be in registration with the bottom right notch internal edge of internal piece 12; and the top left notch internal edge of corner piece 2 will not be in registration with the bottom left projection internal edge of side piece 7. To proceed farther toward assembly of the puzzle, therefore, some of the puzzle must be dismantled.

If the side pieces 5 and 7 are interchanged and assembled as shown in FIG. 2B, it will be found that the V' indicia component left projection internal edge of piece 7 will fit the bottom right notch internal edge of side piece 10, and the F indicia component right notch internal edge of side piece 7 will fit the F' indicia component left projection internal edge of internal piece 12. Also, the B' right projection internal edge of side piece 5 will fit the B left notch internal edge of corner piece 2. The R' indicia component left projection internal edge of side piece 7 will be spaced from the T indicia component left notch internal edge of corner piece 4 and such projection and notch cannot be interfitted with their piece edges complemental. The projection and notch of the A' and R edges of side pieces 5 and 6 which are adjacent will not be in registration, and the notch and projection of the L and E' edges of side piece 5 and internal piece 12 which are adjacent will not be in registration. Again, the apparent progress toward solution of the puzzle has been misleading and actually continued assembly of the pieces as shown in FIG. 2B has resulted in progressive error in assembly of the puzzle pieces.

In further dismantling the puzzle from the arrangement of the portions of FIGS. 2A and 2B which are the same, the puzzler may attempt to interchange pieces 6 and 10 as shown in FIG. 2C. In this instance, pieces 1, 9, 3, 11, 12, 4, 8 and 2 have been assembled in the same upper and lower subassemblies as shown in FIGS. 2A and 2B. With side piece 6 thus placed, double projection side pieces 5 and 7 again remain to be placed. If they are assembled in the manner shown in FIG. 2A, it will be found that the B' indicia component right projection internal edge of side piece 5 will be in registration with the M indicia component left notch internal edge of side piece 6. Also, it will be found that the F right notch internal edge of side piece 7 will fit the E' indicia component left projection internal edge of internal piece 12, and the R' indicia component left projection internal edge of side piece 7 will fit the K right notch internal edge of side piece 10. However, the L left notch internal edge of side piece 5 will fit the F' left projection of internal piece 12 only incorrectly to space the B' edge of piece 5 from the M edge of piece 6, the U' edge of piece 8 from the Q edge of piece 12 and the B edge of piece 2 from the V' edge of piece 7. Also the right notch of the P edge of side piece 10 will not be in registration with the right projection of the J' edge of corner piece 3.

Figure 2D:
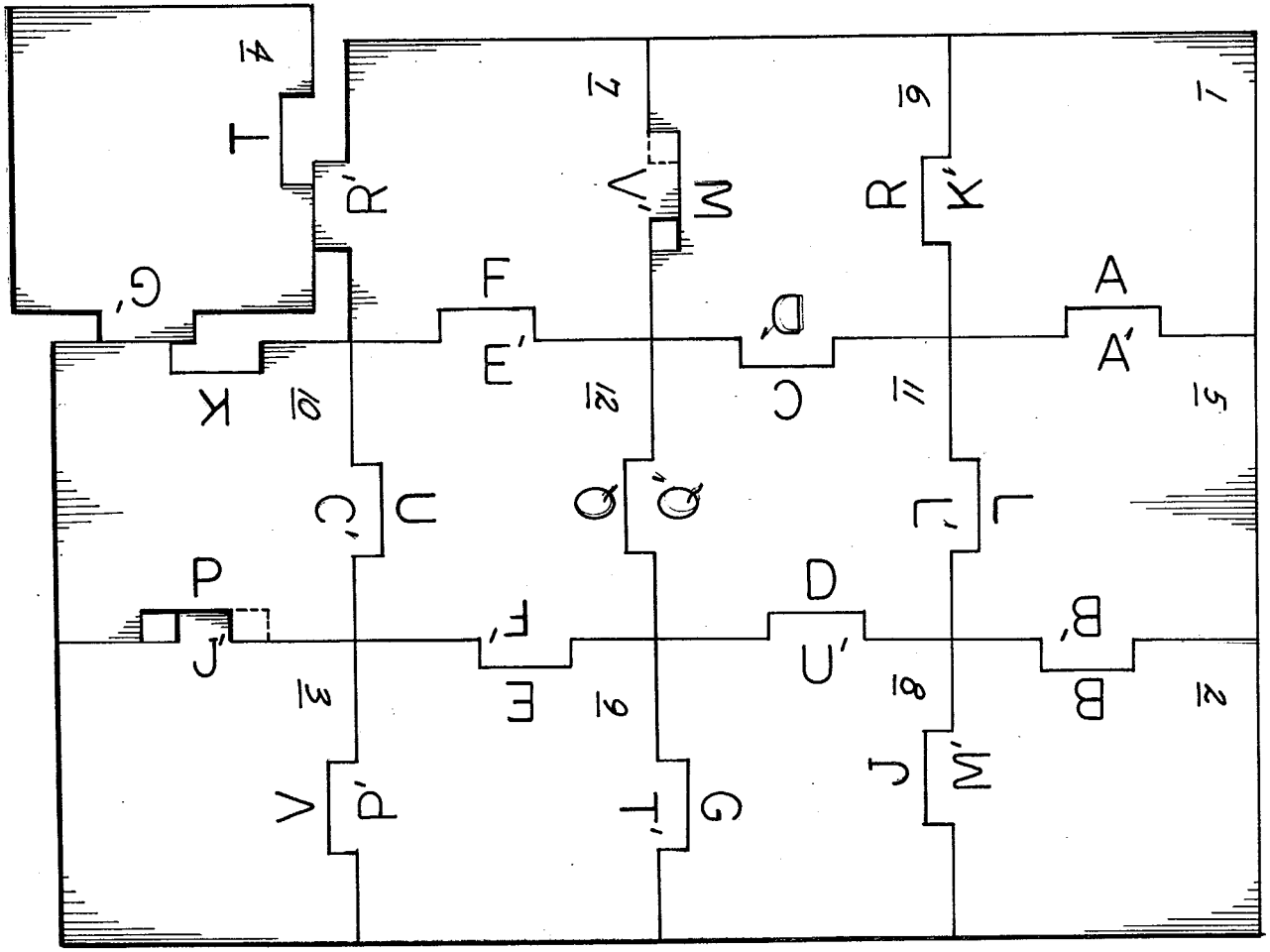

The puzzler having reached this quandary will realize that he has made a mistake earlier than the assembly of pieces 1, 9, 3, 11 and 12 and that he must dismantle at least some of these pieces. Therefore, the puzzler may assemble pieces 1, 5 and 2 in their proper locations. Both piece 6 and piece 10 have, in clockwise sequence from their straight border edge, a right notch internal edge followed by a right projection internal edge, but the third internal edge of piece 6 is a left notch edge whereas the third internal edge of piece 10 is a right notch edge. Not recognizing the incorrect correlation between the K' indicia component of piece 1 and the R indicia component of piece 6, the puzzler may place piece 6 in the piece 10 location as in FIG. 2D even with pieces 1, 5 and 2 correctly assembled. If he did not recognize the incorrect correlation between the D' indicia component of piece 6 and the C indicia component of piece 11, the puzzler could then locate piece 11 in its proper position. Also, piece 8 could be placed in the location of piece 6 shown in FIG. 1, because the J left notch internal edge of piece 8 would fit the M' right projection internal edge of piece 2 and the U' right projection internal edge of piece 8 would fit the D left notch internal edge of piece 11. Piece 12 can then be placed as in FIG. 1. Also the puzzler would probably discover that the T' right projection edge of piece 9 would fit the G left notch edge of piece 8 and the E right notch edge of piece 9 would fit the F' left projection internal edge of piece 12. Continuing, the V right notch internal edge of corner piece 3 will fit the P' left projection internal edge of side piece 9. If the puzzler has progressed this far, he will discover that the remaining unplaced side piece 10 does not have an edge that will complementally abut either corner piece 3 or 4 and the other side piece 7 will not fit the unmatched side of either side piece 6 or corner piece 4. He will then realize that he has again made a mistake.

An unique feature of the present invention which distinguishes it from prior art jigsaw puzzles is the use of corresponding pairs of complementary indicia the components of which, when the puzzle is correctly assembled, are located adjacent to and at opposite sides of the piece joint to serve as clues to the expeditious correct assembly of the puzzle pieces. In FIGS. 1, 2A, 2B, 2C and 2D single complementary letters are located at opposite sides of complementally abutting edges when the puzzle pieces are properly assembled as shown in FIG. 1. Such complementary indicia are simply illustrative and would not be used because of their obvious relationships.

The indicia of the FIG. 1 puzzle are oriented so that the base of one set of indicia, the nonprimed letters, are adjacent to the notch edge and the top of the other set of indicia, the primed letters, are adjacent to the projection edge. A systematic arrangement such as this is used so that the puzzler would not be aided in associating complementary indicia by matching complementally abuttable edges and indicia orientation. For example, if all of the indicia in FIG. 1 were oriented with the base adjacent to the bottom of the figure, the puzzler would not attempt to place piece 6 in the location of piece 10, as discussed above, because he would recognize that the indica would be inverted. Of course, such an indicia orientation might be desirable, if the puzzle were directed toward use by a less sophisticated or younger puzzler. Therefore, the scope of the invention is not limited to any particular orientation of the indicia. The indicia may be orientated in any sequential order, of which FIGS. 11, 13 and 17 are examples, or the pieces may have all of the indicia orientated similarly as in FIG. 15.

Figure 3:
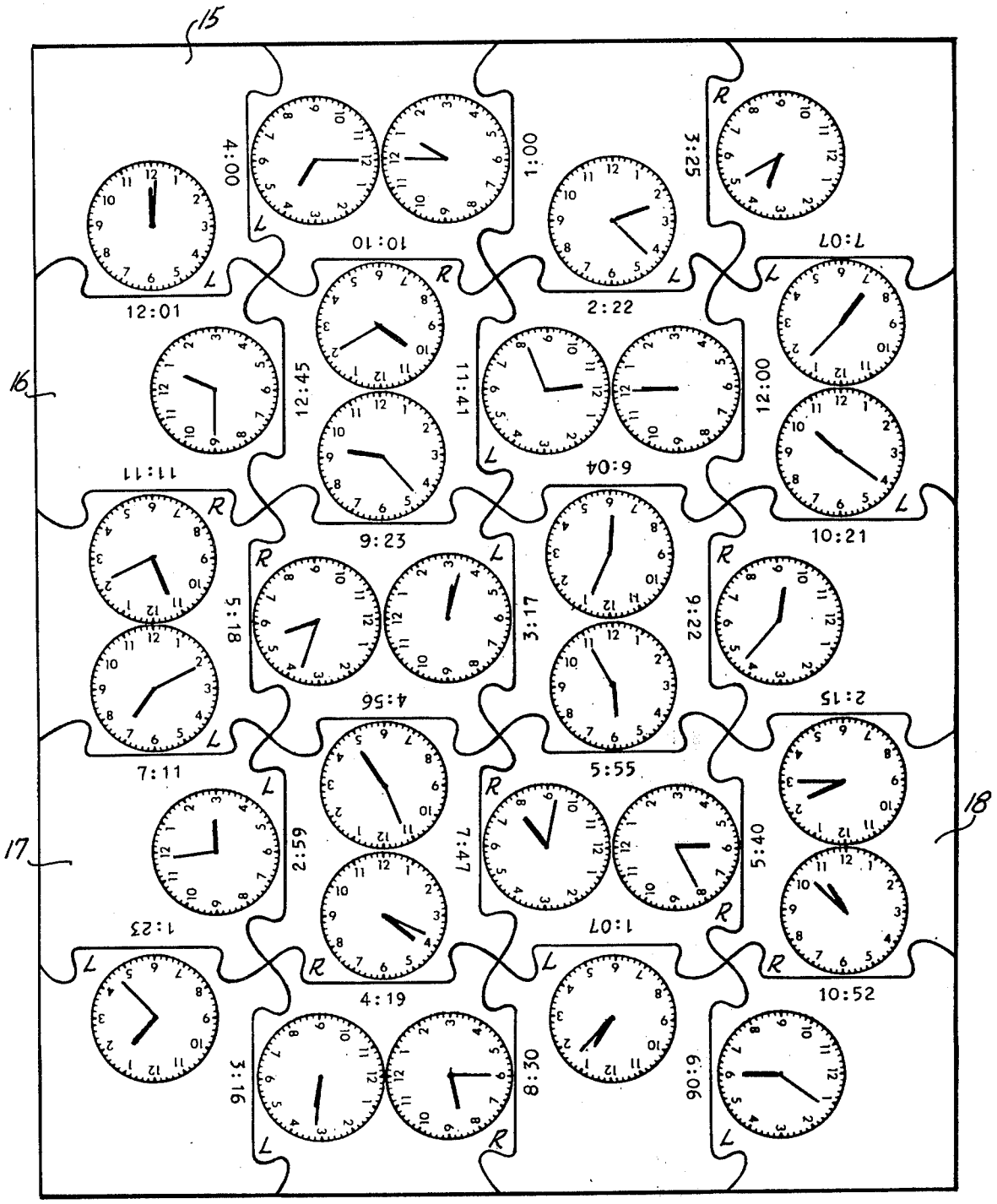
FIG. 3 is a plan of an assembled 20-piece sheet interlocking section puzzle with complementary time legends and clock faces, abutting internal edges including straight edge projections and notches, and ogee or s-cross intersections.

In the example of FIG. 3, the puzzler would recognize or learn that the clock face of piece 15 reads 12:01 and therefore would associate the complementary indicia component of piece 16 and not the indicia component of piece 17 which also has a complementally abuttable right notch internal edge. As the puzzler learns the correlation between the complementary indicia, he may efficiently assemble the puzzle instead of making errors as illustrated by FIGS. 2A to 2D and thereby be rewarded for his learning efforts.

Figure 4:
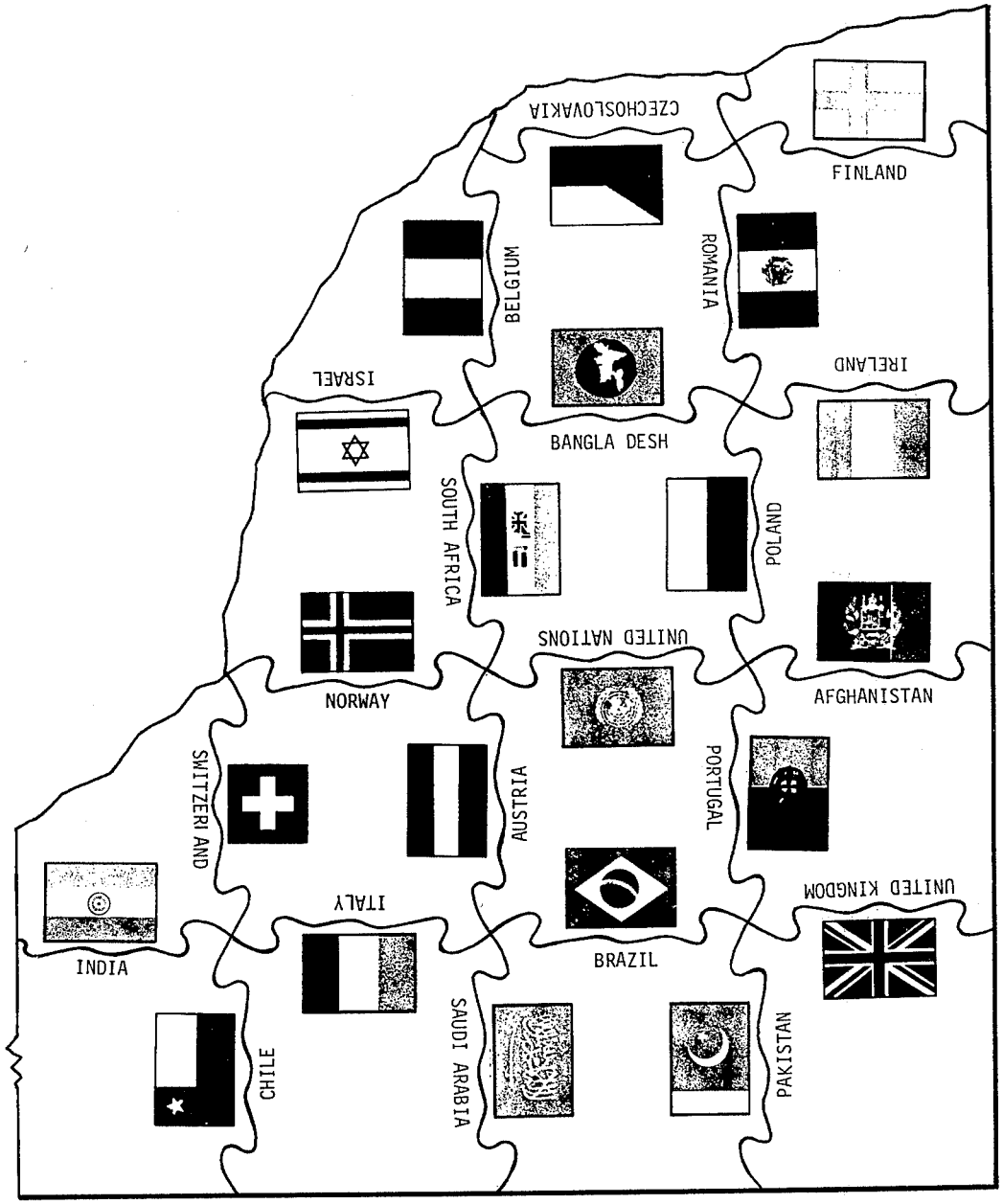
FIG. 4 is a fragmentary plan of another assembled sheet interlocking sectional puzzle with complementary flag and name-of-country indicia, abutting internal edges including undulating edge projections and notches, and ogee or s-cross intersections.
Figure 5:
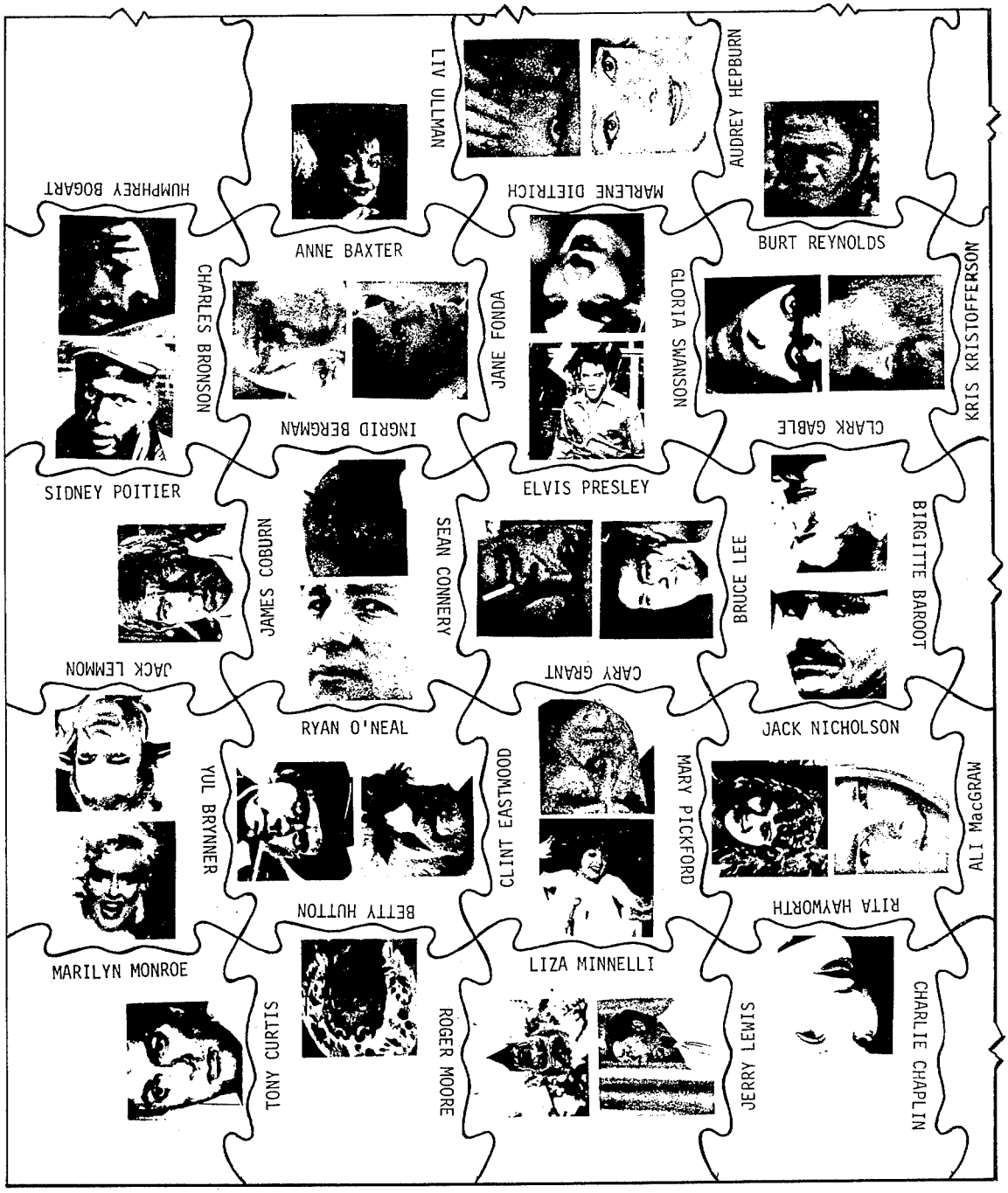
FIG. 5 is a fragmentary plan of another assembled puzzle with complementary picture and name-of-actor or actress indicia, composed of pieces having the same profiles as the pieces of the puzzle of FIG. 4.
Figure 6:
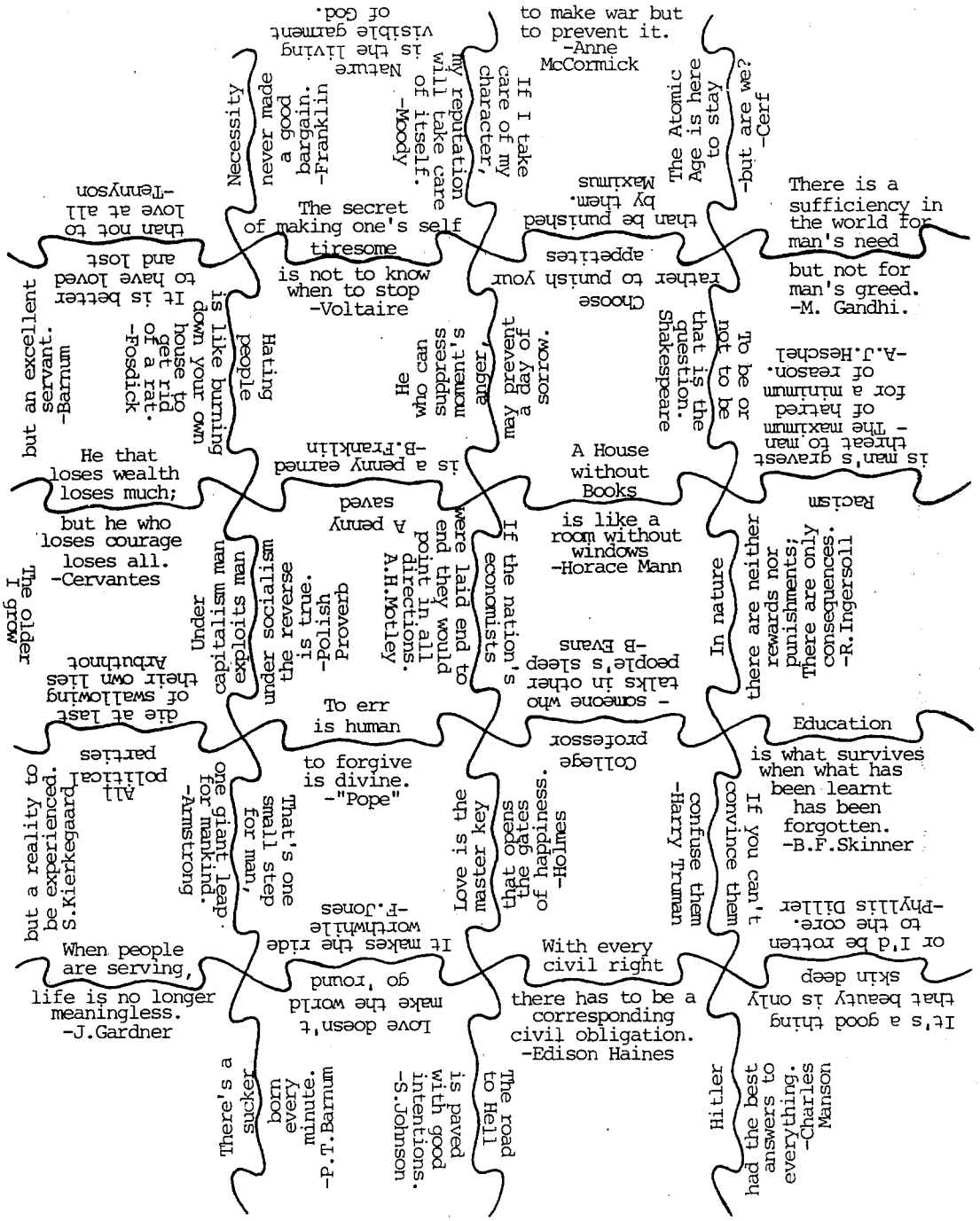
FIG. 6 is a fragmentary plan of another assembled puzzle with divided quotes and familiar sayings as indicia, also composed of pieces having the same profiles as the pieces of the puzzle of FIG. 4.

As demonstrated by FIGS. 4 through 6, the indicia may be pairs of any complementary marks, tokens, signs or words, including national flags, actors and actresses, or quotes and familiar sayings as well as political figures, money, mathmatical propositions, flags, foreign and English words, animals, flowers, trees, chemical formulae or equations, Morse code, or buildings and monuments. Essentially, any indicia with a matching or pairing correlation may be used.

FIG. 3 shows a second embodiment of piece profile with interlocking internal edges including straight edge projections and notches, and s-cross intersections. Close inspection of piece 18 will reveal, clockwise from the straight border edge, a right projection internal edge, a left notch internal edge and a center or narrow projection internal edge. As in the FIG. 1 puzzle the right and left projections are offset to the right and left, respectively, as viewed from the center of the piece. The center or narrow projections and notches have straight edges of a length less than the length of the straight edges of the right and left projections and notches. To aid identification simply in description of the puzzle structure, the FIG. 3 projections have been labeled L for left and R for right.

FIGS. 4 through 6 show a third type of piece profile embodiment of the present invention in which the straight edge notches and projections of FIG. 3 are replaced by undulating edge notches and projections. As best shown in FIGS. 7A to 7C, the center crest of the projections is centered, as in FIG. 7A, offset to the right, as in FIG. 7B, or offset to the left, as in FIG. 7C. FIG. 7D shows another variation in which the center crest is of the same height as in FIG. 7A, but the adjacent troughs are deeper.

Figure 8:
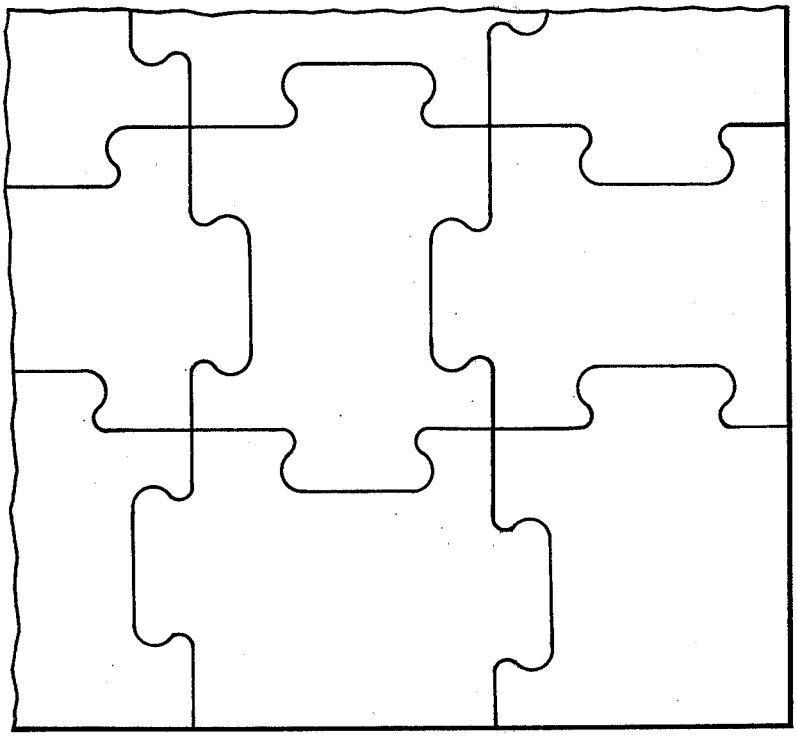
FIG. 8 is a fragmentary plan of another assembled puzzle including interlocking pieces with the complementary indicia omitted, having abutting internal edges including straight edge projections and notches and perpendicularly crossing intersections.
Figure 9:
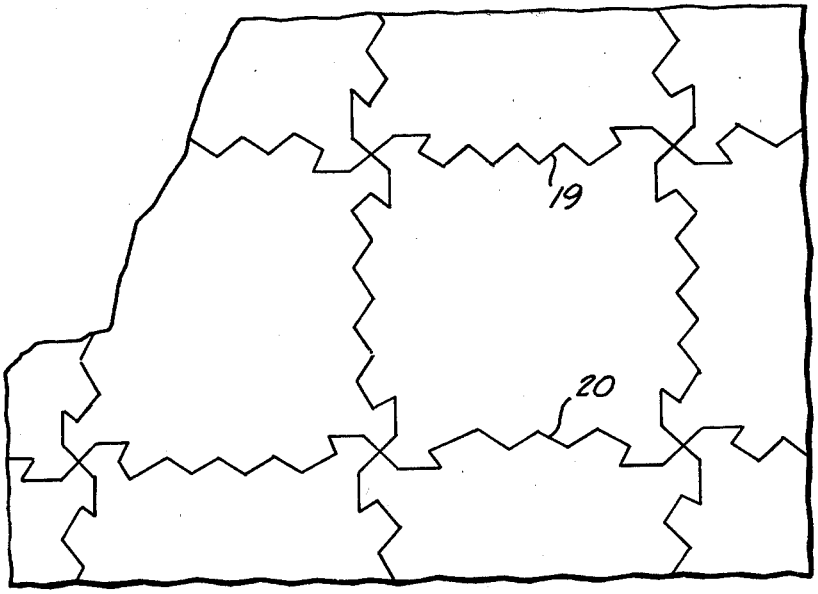
FIG. 9 is a fragmentary plan of an assembled puzzle with indicia omitted having interlocking pieces with abutting internal edges including zigzag projections and notches, and modified swastika intersections.

FIG. 8 shows another embodiment of the present invention in which the intersections are perpendicular straight lines and the projections and notches are offset left and right. FIG. 9 shows a further variation of the present invention including pieces with zigzag projections and notches and interlocking modified swastika intersections. In addition to offsetting the projections and notches as in the preceding examples, the number of zigzags may be varied, as illustrated by the internal edges 19 and 20 of FIG. 9.

Another variation in projections and notches is shown in FIG. 10 in which each internal edge has a pair of complementary undulating projections and notches. Similar to the undulations in FIGS. 7A to 7C, the crest or trough is offset left, centered, or offset right. Any number of projections and notches can be provided on each internal edge. Each piece internal edge need not have an equal number of complementary projections and notches.

FIG. 11 shows another noninterlocking puzzle outline with each abutting internal edge including one projection and one notch. As best shown in FIGS. 11A to 11C, the projections and notches are centered, shifted right or shifted left.

Of course, any size and number of incongruent pieces with numerous identical edges may be used. Also the piece profile need not be square, but may be rectangular; hexagonal, as shown in FIG. 12; pentagonal, as shown in FIG. 13; triangular, as shown in FIG. 14; or any other regular shape. Irregular shapes are not favored because there would be less opportunity to assemble the puzzle incorrectly if correlating of indicia were not relied upon.

The present invention is intended to include any variation in piece shape, and edge and intersection configuration, including nonstraight border edges and noninterlocking, as well as interlocking, intersections. Further, the present invention is not limited to pieces with alternating adjacent projection and notch internal edges.

An additional embodiment of the present invention, shown in FIGS. 15 and 16, consists of a frame 21 and twenty square puzzle pieces. The frame 21 has four side members 22 and a base 23. The corner pieces, of which piece 24 is representative, include two adjacent border edges with no adjacent indicia components or internal edge symbols, i.e. the small diamonds and squares which are bisected by the piece internal edges, and two internal edges, each with an adjacent indicia component and internal edge symbols. The side pieces 25 to 28 include one border edge and three internal edges. The internal pieces 29 to 31 include four internal edges.

Each internal edge has an adjacent indicia component and two bisected internal edge symbols. The internal edge symbols are impressed into the puzzle pieces as shown in FIG. 16 or printed on the piece surface. The pieces are "incongruent" because, although all pieces are identical in size and shape, no two pieces have an identical sequence of internal edge symbols about their circumference. The squares and diamonds of the FIG. 15 puzzle function similarly to the projections and notches of the preceding embodiments making the internal edges complementally or noncomplementally abuttable. For example, the edge of piece 31 adjacent to the P′ indicia component is complementally abuttable with the edge of piece 25 adjacent to the E′ indicia component, since the two pieces when aligned in abutting relationship form two square internal edge symbols. However the edge of piece 31 adjacent to the P′ indicia component is not complementally abuttable with the edge of piece 28 adjacent to the M indicia component because the half diamond and half square internal edge symbols do not match when the pieces are aligned in abutting relationship; that is the internal configurations are not complementally abuttable. The FIG. 15 puzzle is assembled in the same manner as the FIG. 1 puzzle except that the complementally abuttable internal configuration is the bisected internal edge symbols instead of the projection-and-notch profiles of FIG. 1.

The term "complementally abuttable configuration" is defined as the variations in the piece internal edges which may be placed in complementally abutting relationship by mechanical or visual matching. It is a generic term, and includes profile, such as projections and notches, and features such as symbols, marks or color coding which are bisected by a joint between contiguous piece edges.

FIG. 17 shows another form of a complementally abuttable internal configuration which consists of wide and narrow line segments bisected by the piece internal edges. Further, the different types of complementally abuttable internal configurations, such as profile and bisected symbols, may be combined as shown in FIGS. 18 and 19.

Figure 19:
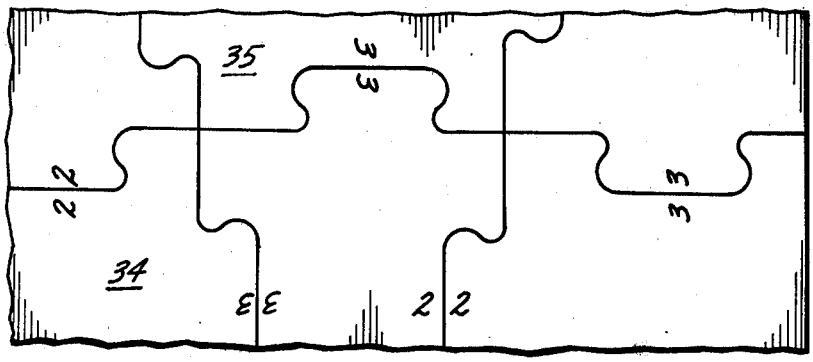

It is to be emphasized that the internal edge symbols which are bisected by the internal edges and are shown in FIGS. 15 and 17 to 19 are not "complementary indicia" as used in the description of this invention. The complementary indicia are associated by the corresponding meaning relationship whereas the internal edge symbols are identical and are visually matched. Therefore, while the numerals in FIG. 19 are physically separated, the numerals of each pair are identical and are visually matched, and are internal edge symbols. It is to be noted that, as in the other embodiments, there are identical complementally abuttable internal edges which may fit a particular location as the puzzle is being assembled, but the puzzle cannot be fully assembled unless the indicia are complementary. For example, in FIG. 19, the right projection edge of piece 34 will fit into the left notch edge of piece 35.

As the number and combinations of distinct complementally abuttable internal configurations are increased, the number of pieces which appear similar but are incongruent may be increased while retaining the feature of only one possible fully assembled combination or solution to the puzzle.

I claim:

1. A sheet puzzle comprising:

a plurality of at least twelve pieces, each piece having an internal edge, some pieces being external pieces having an internal edge and an external edge, and at least two of said pieces being internal pieces having only internal edges, the profile of a majority of said internal edges being nonlinear, the profile of each of a plurality of said internal edges being complemental to the profile of each of a plurality of other internal edges and fittable contiguously therewith, all of said pieces being capable of being arranged in one and only one combination with each piece internal edge in complementally abutting relationship with an internal edge of another piece, each of said pieces being incongruent as to shape with respect to all other of said pieces and no combination of complementally abutted pieces in said one and only one combination being congruent as to shape with any other combination of complementally abutted pieces in said one and only one combination, a first internal edge of a first piece being complementally abuttable with a first internal edge of a second piece and with a first internal edge of a third piece, and portions of said first piece, said second piece and said third piece adjacent to said respective first internal edges each bearing an indicium and the indicium adjacent to said first internal edge of said first piece being meaningfully associated with said indicium adjacent to said first internal edge of said second piece but not being meaningfully associated with said indicium adjacent to said first internal edge of said third piece, thereby enabling less than all of said pieces to be arranged with each internal edge in complementally abutting relationship with another internal edge and with said first internal edge of said first piece fitting contiguously said first internal edge of said third piece placing in adjacent relationship indicia not meaningfully associated, whereas when said pieces are all arranged in said one and only one combination said first internal edge of said first piece will be fitted complementally with said first internal edge of said second piece placing in adjacent relationship indicia which are meaningfully associated.

2. The sheet puzzle defined in claim 1, the portion of each piece adjacent to each internal edge bearing an indicium of a character such that, when all of the pieces are arranged in the one and only one combination, meaningful associated indicia is disposed in adjacent relationship at opposite sides of each pair of complementally abutting edges.

3. The puzzle defined in claim 1 or 2, in which each internal edge interlocks with its complementally abutting internal edge in such one and only one combination.

4. A sheet puzzle comprising:

a plurality of at least twelve pieces, each piece having an internal edge, some pieces being external pieces having an internal edge and an external edge, and at least two of said pieces being internal pieces having only internal edges, the profile of a majority of said internal edges being nonlinear, the profile of each of a plurality of said internal edges being complemental to the profile of each of a plurality of other internal edge of said pieces, respectively, all of said pieces being capable of being arranged in one and only one combination with each piece internal edge in complementally abutting relationship with an internal edge of another piece, each of said pieces being incongruent as to shape with respect to all other of said pieces and no combination of complementally abutted pieces in said one and only one combination being congruent as to shape with any other combination of complementally abutted pieces in said one and only one combination, and all of said pieces being capable of being arranged in a second combination with each piece external edge adjacent to and substantially aligned with an external edge of another piece and with each of a majority of said internal edges complementally abutting an internal edge of another piece other than that which it abuts in said one and only one combination and with other internal edges incapable of complemental abutment disposed in adjacent relationship.

5. A sheet puzzle comprising:

a plurality of at least twelve pieces, each piece having an internal edge, some pieces being external pieces having an internal edge and an external edge, and at least two of said pieces being internal pieces having only internal edges, a plurality of said internal edges being complemental to a plurality of other internal edges, respectively, all of said pieces being capable of being arranged in one and only one combination with each piece internal edge in complementally abutting relationship with an internal edge of another piece, each of said pieces being incongruent with respect to all other of said pieces and no combination of complementally abutted pieces in said one and only one combination being congruent with any other combination of complementally abutted pieces in said one and only one combination, and all of said pieces being capable of being arranged in a second combination with each piece external edge adjacent to and substantially aligned with an external edge of another piece and with each of a majority of said internal edges complementally abutting an internal edge of another piece other than that which it abuts in said one and only one combination and with other internal edges incapable of complemental abutment disposed in adjacent relationship.

6. The puzzle defined in claim 4 or 5, in which each piece has an indicium adjacent to each of its internal edges and the indicia at opposite sides of each pair of complementally abutting internal edges when the pieces are in such one and only one combination being associated by a complementary meaning relationship.

7. The puzzle defined in claim 4 or 5, in which each internal edge interlocks with its complementally abutting internal edge in such one and only one combination.

8. A sheet puzzle comprising:

at least several pieces having external and internal types of edges, the profile of a majority of said internal edges being nonlinear, the profile of each of a plurality of internal edges of said pieces being complemental to the profile of each of a plurality of other internal edges of said pieces, respectively, said internal edges having profiles which enable all of said pieces to be mechanically interfitted in one and only one combination with each internal edge of each piece in complementally abutting relationship with an internal edge of another piece, each of said pieces being incongruent as to shape with respect to all other of said pieces and no combination of complementally abutted pieces in said one and only one combination being congruent as to shape with any other combination of complementally abutted pieces in said one and only one combination, two of said pieces having the same number of internal edges, each of said two pieces having not more than one external edge, and a combination of two adjacent internal edges of one of said two pieces being congruent as to shape with a combination of two adjacent internal edges of the other of said two pieces.

9. A sheet puzzle comprising:

at least several pieces having external and internal types of edges, a plurality of internal edges of said pieces being complemental to each of a plurality of internal edges of others of said pieces, respectively, all of said pieces being capable of being arranged in one and only one combination with each internal edge of each piece in complementally abutting relationship with an internal edge of another piece, each of said pieces being incongruent with respect to all other of said pieces and no combination of complementally abutted pieces in said one and only one combination being congruent with any other combination of complementally abutted pieces in said one and only one combination, two of said pieces having the same number of internal edges, each of said two pieces having not more than one external edge, and a combination of two adjacent internal edges of one of said two pieces being congruent with a combination of two adjacent internal edges of the other of said two pieces.

10. The puzzle defined in claim 8 or 9, in which each piece has an indicium adjacent to each of its internal edges and the indicia at opposite sides of each pair of complementally abutting internal edges when the pieces are in such one and only one combination being associated by a complementary meaning relationship.

11. The puzzle defined in claim 8 or 9, in which each internal edge interlocks with its complementally abutting internal edge in such one and only one combination.

12. A sheet puzzle comprising a plurality of pieces of generally the same size and shape, which plurality of pieces can be arranged in one and only one combination with each piece internal edge in complementally abutting relationship with an internal edge of another piece, each piece being incongruent with respect to all other pieces and no combination of complementally abutted pieces in said one and only one combination being congruent with any other combination of complementally abutted pieces in said one and only one combination, each of a plurality of internal edges of said pieces being complemental to each of a plurality of other internal edges of said pieces and fittable contiguously therewith, which plurality of pieces include at least two internal pieces having only internal edges, each edge of a first one of said internal pieces bearing an indicium having a base and a top with only its base located adjacent to such internal edge of said first internal piece and each edge of a second one of said internal pieces bearing an indicium having a base and a top with only its top located adjacent to such internal edge of said second internal piece.

13. The puzzle defined in claim 12, in which each piece is incongruent with respect to all other pieces as to contour and the contour of each of a plurality of piece internal edges is complemental to the contour of each of a plurality of other piece internal edges and fittable contiguously therewith.

14. The puzzle defined in claim 13, in which every piece internal edge is complemental to each of a plurality of other piece internal edges and fittable contiguously therewith.

15. A sheet puzzle comprising a plurality of pieces, which plurality of pieces can be arranged in one and only one combination with each piece internal edge in complementally abutting relationship with an internal edge of another piece, each piece being incongruent with respect to all other pieces and no combination of complementally abutted pieces in said one and only one combination being congruent with any other combination of complementally abutted pieces in said one and only one combination, every internal edge of said pieces being complemental to each of a plurality of other internal edges of said pieces and fittable contiguously therewith, which plurality of pieces include at least two internal pieces having only internal edges, each edge of a first one of said internal pieces bearing an indicium having a base and a top with only its base located adjacent to such internal edge of said first internal piece and each edge of a second one of said internal pieces bearing an indicium having a base and a top with only its top located adjacent to such internal edge of said second internal piece.

16. The puzzle defined in claim 15, in which each piece is incongruent with respect to all other pieces as to contour and the contour of every piece internal edge is complemental to the contour of each of a plurality of other piece internal edges and fittable contiguously therewith.

17. The puzzle defined in claim 12 or 15, in which each piece has an indicium component adjacent to each of its internal edges, the indicia components at opposite sides of each pair of internal edges which complementally abut when the pieces are assembled in such one and only one combination being associated by a complementary meaning relationship.

* * * * *

UNITED STATES PATENT AND TRADEMARK OFFICE

CERTIFICATE OF CORRECTION

PATENT NO. : 4,361,328
DATED : November 30, 1982
INVENTOR(S) : Age Stein and Douglas E. Winters It is certified that error appears in the above-identified patent and that said Letters Patent are hereby corrected as shown below:

Column 1, line 7, cancel "moe" and insert ---more---.

Column 2, line 9, cancel "rearward" and insert ---rewarded---.

Column 5, line 36, cancel "p'" and insert ---P'---.

Column 11, line 18, cancel "is" and insert ---are---.

Signed and Sealed this

*Fifteenth* Day of *March 1983*

[SEAL]

*Attest:*

GERALD J. MOSSINGHOFF

*Attesting Officer*

*Commissioner of Patents and Trademarks*